US010981076B2

(12) United States Patent
Missler

(10) Patent No.: US 10,981,076 B2
(45) Date of Patent: Apr. 20, 2021

(54) CIRCUIT ARRANGEMENT FOR A MODEL CAR RACING TRACK

(71) Applicant: STADLBAUER MARKETING + VERTRIEB GMBH, Puch bei Salzburg (AT)

(72) Inventor: Roman Missler, Lebach (DE)

(73) Assignee: Stadlbauer Marketing +Vertrieb GMBH, Salzbury (AT)

( * ) Notice: Subject to any disclaimer, the term of this patent is extended or adjusted under 35 U.S.C. 154(b) by 252 days.

(21) Appl. No.: 16/070,681

(22) PCT Filed: Jan. 24, 2017

(86) PCT No.: PCT/EP2017/000080
§ 371 (c)(1),
(2) Date: Jul. 17, 2018

(87) PCT Pub. No.: WO2017/129357
PCT Pub. Date: Aug. 3, 2017

(65) Prior Publication Data

US 2019/0054385 A1 Feb. 21, 2019

(30) Foreign Application Priority Data

Jan. 26, 2016 (DE) ..... 10 2016 000 774.5

(51) Int. Cl.
*A63H 18/12* (2006.01)
*A63H 18/00* (2006.01)
*A63H 18/02* (2006.01)

(52) U.S. Cl.
CPC ..... *A63H 18/12* (2013.01); *A63H 18/005* (2013.01); *A63H 18/026* (2013.01)

(58) Field of Classification Search
CPC .... A63H 18/005; A63H 18/026; A63H 18/12; A63H 19/24; A63H 19/14; A63H 18/02; A63H 19/34; A63H 30/02; A63H 30/00
See application file for complete search history.

(56) References Cited

U.S. PATENT DOCUMENTS

| | | | | |
|---|---|---|---|---|
| 3,432,166 A | | 3/1969 | Goldfarb | |
| 3,774,340 A | | 11/1973 | Barlow et al. | |
| 4,333,261 A | | 6/1982 | Jones et al. | |
| 4,415,157 A | | 11/1983 | Lahr | |
| 4,697,812 A | * | 10/1987 | Rudell | A63H 18/12 104/305 |

(Continued)

FOREIGN PATENT DOCUMENTS

| | | |
|---|---|---|
| CN | 2088888 U | 11/1991 |
| CN | 103845904 A | 6/2014 |

(Continued)

*Primary Examiner* — Mark T Le
(74) *Attorney, Agent, or Firm* — DeLio Peterson & Curcio LLC; Brian G. Schlosser

(57) ABSTRACT

A circuit arrangement for a model car racing track, having at least two tracks for model cars, wherein a positive busbar and a negative busbar are in each case assigned to each track, and a first driving speed controller is connected between a positive supply terminal and the positive busbar of the first track and a second driving speed controller is connected between a negative supply terminal and the negative busbar of the second track.

11 Claims, 1 Drawing Sheet

(56) References Cited

U.S. PATENT DOCUMENTS

| | | | | |
|---|---|---|---|---|
| 5,297,484 | A * | 3/1994 | Piserchia | A63H 19/00<br>104/DIG. 1 |
| 5,813,351 | A * | 9/1998 | Chen | A63H 18/02<br>104/60 |
| 8,154,227 | B1 * | 4/2012 | Young | A63H 30/04<br>318/255 |
| 2006/0196384 | A1 | 9/2006 | Faulcon | |

FOREIGN PATENT DOCUMENTS

| | | | |
|---|---|---|---|
| DE | 202011107901 | U1 | 12/2011 |
| FR | 2448374 | A1 | 9/1980 |

* cited by examiner

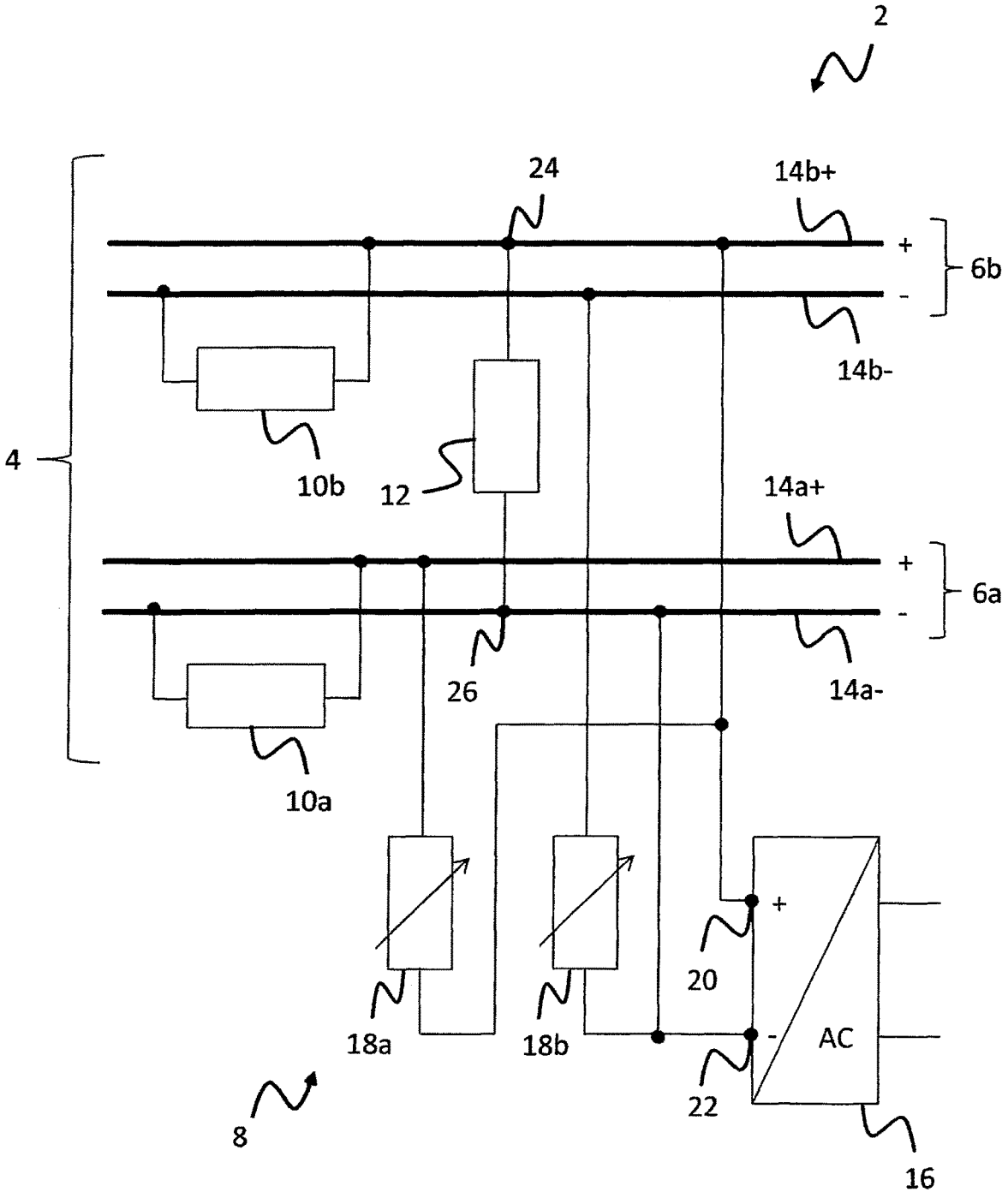
2
24
14b+
+
6b
-
14b-
4
10b
12
14a+
+
6a
-
26
14a-
10a
+
20
18a
18b
-
AC
22
8
16

CIRCUIT ARRANGEMENT FOR A MODEL CAR RACING TRACK

BACKGROUND OF THE INVENTION

1. Field of the Invention

The invention relates to a circuit arrangement for a model car racing track. The invention also relates to a model car racing track with such a circuit arrangement and a track element for such a model car racing track.

2. Description of Related Art

A model car racing track, also referred to as a slot car track or slot track, is a technical device by means of which electrically driven model cars are driven, guided on tracks.

The model car racing track comprises a track which can for example be assembled from a plurality of track elements which can be plugged together. As a rule, the track has at least two tracks which in each case have a slot to guide in each case one model car and in each case two busbars which supply power to the electrical drive of the model cars which can be moved along the respective track. Current collectors of the respective model cars are thereby in contact with the respective busbar in order to guarantee the transmission of electrical energy. The speed and braking behavior of the respective model car can in each case be controlled by means of a hand controller.

A power supply unit rectifies an AC supply voltage and supplies an electrical DC voltage. One of the busbars of each track is designed as a positive busbar, while the other busbar is designed as a negative busbar. In order to control the speed of the respective model cars, the hand controllers in each case comprise a driving speed controller with for example a variable ohmic resistance. The respective driving speed controllers for controlling the speed of the two model cars are connected either with the negative supply terminal or the positive supply terminal of the power supply unit.

A model car racing track is known from US 2006/0196384 A1 in which a plurality of model cars can drive on one and the same track. Several parallel busbars are provided for this purpose, whereby a special current collector of the model cars is designed to select particular busbars. An electrical DC voltage is used as supply voltage for the model cars, whereby the driving speed controllers are connected between a positive terminal of a power supply unit and the respective busbars. Moreover, pit stop module is provided in the model car racing track according to the aforementioned publication.

However, this type of circuit does not provide a constant supply voltage for the operation of an electrical consumer which is arranged in a selected position on the track. Such a consumer can for example be a pit stop module for a pit stop or an electrical lap counter. Rather, in order to provide an electrical supply voltage for the operation of such an electrical consumer it is necessary also to supply this with electrical energy from a further voltage source, for example a battery. However, this can lead to unintentional interruptions in operation due to the exhaustion of the battery, which can lead to play being terminated.

SUMMARY OF THE INVENTION

The invention is based on the problem of providing a way of making the supply of such an electrical consumer with electrical energy more reliable. According to the invention this problem is solved by means of a circuit arrangement of the aforementioned type with the characterizing features delineated in the independent claims. Advantageous embodiments of the invention are described in the further dependent claims.

The above and other objects, which will be apparent to those skilled in the art, are achieved in the present invention which is directed to a circuit arrangement for a model car racing track comprising at least two tracks for model cars, wherein a positive busbar and a negative busbar are in each case assigned to each track, such that a first driving speed controller is connected between a positive supply terminal and the positive busbar of the first track and a second driving speed controller is connected between a negative supply terminal and the negative busbar of the second track.

The positive supply terminal is preferably connected in an electrically conductive manner with the positive busbar of the second track and the negative supply terminal is connected in an electrically conductive manner with the negative busbar of the first track.

An electrical consumer may be connected between the negative busbar of the first track and the positive busbar of the second track.

The positive supply terminal and the negative supply voltage terminal are assigned to a power supply unit.

The negative busbar of the second track may be arranged between the positive busbar of the first track and the positive busbar of the second track and the positive busbar of the first track is arranged between the negative busbar of the first track and the negative busbar of the second track.

In a second aspect, the present invention is directed to a model car racing track comprising at least two tracks for model cars, wherein each track is assigned a positive busbar and a negative busbar, and a circuit arrangement having at least two tracks for model cars, wherein a positive busbar and a negative busbar are in each case assigned to each track, such that a first driving speed controller is connected between a positive supply terminal and the positive busbar of the first track and a second driving speed controller is connected between a negative supply terminal and the negative busbar of the second track.

An electrical consumer may also be connected between the negative busbar of the first track and the positive busbar of the second track.

The model car racing track may include a track element with a positive consumer terminal and a negative consumer terminal to which the electrical consumer is connected.

The electrical consumer is designed as an electrical lap counter or as a pit stop module.

In a third aspect, the present invention is directed to a track element for a model car racing track, said model car racing track having at least two tracks for model cars, wherein each track is assigned a positive busbar and a negative busbar, and a circuit arrangement having at least two tracks for model cars, wherein a positive busbar and a negative busbar are in each case assigned to each track, such that a first driving speed controller is connected between a positive supply terminal and the positive busbar of the first track and a second driving speed controller is connected between a negative supply terminal and the negative busbar of the second track, wherein the track element has at least one positive consumer terminal and one negative consumer terminal for connection of an electrical consumer.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

The attached FIGURE shows a schematic representation of a preferred embodiment of a model car racing track according to the invention.

DESCRIPTION OF THE PREFERRED EMBODIMENT(S)

In describing the preferred embodiment of the present invention, reference will be made herein to the attached FIGURE in which like numerals refer to like features of the invention.

In a circuit arrangement for a model car racing track with at least two tracks for model cars, wherein a positive busbar and a negative busbar are in each case assigned to each track, a first driving speed controller is connected between a positive supply terminal and the positive busbar of the first track and a second driving speed controller is connected between a negative supply terminal and the negative busbar of the second track.

This has the advantage that in each case one of the two positive busbars and the two negative busbars is connected directly, i.e., without interposition of an ohmic resistor, in an electrically conductive manner, with the respective positive supply terminal or negative supply terminal. These two busbars, i.e., the negative busbar of the first track and the positive busbar of the second track, thus provide a constant direct current supply voltage which can be used as supply voltage for such an electrical consumer. This makes it possible to dispense with batteries as an energy source and in this way guarantees an uninterrupted supply of such an electrical consumer with electrical energy.

According to a preferred embodiment, the positive supply terminal is connected in an electrically conductive manner with the positive busbar of the second track and the negative supply terminal is connected in an electrically conductive manner with the negative busbar of the first track. In this way, a circuit arrangement for operation of a model car racing track is provided which has a particular simple structure not involving digital technology, the model cars being driven by direct current motors and their driving speed being controllable by means of the voltage level.

According to a preferred embodiment, an electrical consumer is connected between the negative busbar of the first track and the positive busbar of the second track. This makes it possible to arrange such an electrical consumer, for example a pit stop module for a pit stop or an electrical lap counter, in any position along the track and supply it with electrical energy.

According to a preferred embodiment, the positive supply terminal and the negative supply voltage terminal are assigned to a power supply unit. The power supply unit is designed for connection to a domestic power supply network and transforms an AC voltage of for example 230 V with 50 Hz into a low-level electrical DC voltage such as an extra low voltage or safety extra low voltage (SELV) of for example maximum 60 volts in order to reduce the potential hazard associated with high electrical voltages. With such an electrical DC voltage, protection against contact can be dispensed with entirely because electrical DC voltages of this level are classed as being non-hazardous, for example for children. The power supply unit can be a transformer power supply unit or a switching power supply unit.

According to a preferred embodiment, the negative busbar of the second track is arranged between the positive busbar of the first track and the positive busbar of the second track and the positive busbar of the first track is arranged between the negative busbar of the first track and the negative busbar of the second track. Through this arrangement of the busbars it is ensured that the busbars of both tracks have the same arrangement, so that model cars with direct current motors move in the same driving direction due to having the same polarity. It is thus not necessary to provide the model cars with an operable driving direction changing switch or a reverse polarity protection circuit. This means the model cars can have a particularly simple structure.

The invention also relates to such a circuit arrangement and a track element for forming a track for such a model car racing track with at least one positive consumer terminal and one negative consumer terminal for connection of an electrical consumer.

The attached FIGURE shows a model car racing track 2, also referred to as a slot car track or slot track.

The model car racing track 2 comprises a track made up of a plurality of track elements 4 which can be plugged together in an axial direction, which in the present exemplary embodiment has a first track 6*a* and a second track 6*b*, in each case for a model car 10*a*, 10*b*. Only one track element 4 is shown in the FIGURE, and the two model cars 10*a*, 10*b* are in each case provided with a direct current motor as drive, in each case symbolized in the FIGURE by an ohmic resistance.

Each track, i.e., the first track 6*a* and the second track 6*b*, has a positive busbar 14*a*+, 14*b*+ and a negative busbar 14*a*−, 14*b*−. The positive busbars 14*a*+, 14*b*+ and the negative busbars 14*a*−, 14*b*− are pressed into recesses in the track elements 4. Furthermore, in the present exemplary embodiment the positive busbars 14*a*+, 14*b*+ and negative busbars 14*a*−, 14*b*− are in each case designed as a single piece, consisting of a uniform material, and are manufactured from a magnetic material. In this way, the respective model cars 10*a*, 10*b* can be track-guided through magnetic force by means of a permanent magnet (not shown) which interacts with the respective positive busbars 14*a*+, 14*b*+ and negative busbars 14*a*−, 14*b*−.

In the present exemplary embodiment, the first track 6*a* is assigned to the first model car 10*a* and the second track 6*b* is assigned to the second model car 10*b*, i.e., in the present exemplary embodiment it is not intended that the first model car 10*a* can change from the first track 6*a* to the second track 6*b*, for example in a switch point section of the track, for example in response to a corresponding control signal. In other words, in the present exemplary embodiment the model car racing track 2 is of fixed-track design.

In the present exemplary embodiment, a circuit arrangement 8 associated with the model car racing track 2 has a power supply unit 16, for example a transformer or switching power supply unit, as well as a first driving speed controller 18*a* for the first model car 10*a* and a second driving speed controller 18*b* for the second model car 10*b*. The first driving speed controller 18*a* and the second driving speed controller 18*b* can be designed as hand controllers equipped with a potentiometer or as semiconductor circuits with for example a MOSFET and can be connected with the power supply unit 16 via cables, or hand controllers (not shown) are provided which transmit control signals wirelessly to the first driving speed controller 18*a* and the second driving speed controller 18*b*, which then adjust the respective voltage level of the electrical DC voltage and thus the driving speed of the respective model car 10*a*, 10*b*.

The power supply unit 16 is designed to transform a mains AC voltage of for example 230 V with 50 Hz into a low-level electrical DC voltage such as an extra low voltage or safety extra low voltage (SELV) of for example maximum 60 volts. The electrical DC voltage is supplied at a positive supply terminal 20 and a negative supply terminal 22 of the power supply unit 16.

In the present exemplary embodiment, the first driving speed controller 18*a* is connected between the positive supply terminal 20 of the power supply unit 16 and the positive busbar 14*a*+ of the first track 6*a*. Also, the second driving speed controller 18*b* is connected between the negative supply terminal 22 of the power supply unit 16 and the negative busbar 14*b*− of the second track 6*b*. The first driving speed controller 18*a* is thus connected in an electrically conductive manner with the positive supply terminal 20 of the power supply unit 16 and the second driving speed controller 18*b* is connected in an electrically conductive manner with the negative supply terminal 22 thereof.

Furthermore, in the present exemplary embodiment the positive supply terminal 20 of the power supply unit 16 is connected in an electrically conductive manner with the positive busbar 14*b*+ of the second track 6*b* and the negative supply terminal 22 of the power supply unit 16 is connected in an electrically conductive manner with the negative busbar 14*a*− of the first track 6*a*.

Furthermore, in the present exemplary embodiment, the negative busbar 14*b*− of the second track 6*b* is arranged between the positive busbar 14*a*+ of the first track 6*a* and the positive busbar 14*b*+ of the second track 6*b* and the positive busbar 14*a*+ of the first track 6*a* is arranged between the negative busbar 14*a*− of the first track 6*a* and the negative busbar 14*b*− of the second track 6*b*. The polarities of the positive busbars 14*a*+, 14*b*+ and the negative busbars 14*a*−, 14*b*− thus alternate in a direction transverse to the direction of main extension or axial direction of the track in the driving direction of the model cars 10*a*, 10*b*. Through this arrangement of the positive busbars 14*a*+, 14*b*+ and the negative busbars 14*a*−, 14*b*− it is ensured that the positive busbar 14*a*+ and the negative busbar 14*a*− of the first track 6*a* and the positive busbar 14*b*+ and the negative busbar 14*b*− of the second track 6*b* have the same arrangement, so that the two model cars 10*a*, 10*b* move in the same driving direction.

In addition to the two model cars 10*a*, 10*b*, a further electrical consumer 12 is provided. The electrical consumer 12 can for example be an electrical lap counter or a pit stop module for a pit stop which requires an electrical DC voltage as supply voltage.

The electrical lap counter allows the number of laps driven on a ring-formed or closed track by each of the two model cars 10*a*, 10*b* to be counted, while the pit stop module can be used to simulate pit stops during which, in real motor racing, the tires are for example changed or the vehicle refueled.

In the present exemplary embodiment, the electrical consumer 12 is connected between the negative busbar 14*a*− of the first track 6*a* and the positive busbar 14*b*+ of the second track 6*b*, whereby this arrangement on the positive busbar 14*b*+ and negative busbar 14*a*− provides a constant DC voltage as electrical supply voltage due to their direct connection with the power supply unit 16, i.e. without the interposition of the first driving speed controller 18*a* and the second driving speed controller 18*b*.

In order to allow electrical contact to be made with the electrical consumer 12 in a simple manner, the track element 4 includes a positive consumer terminal 24 and a negative consumer terminal 26. This can be designed as a plug-in contact with reverse polarity protection in order to make possible a particularly simple connection of the electrical consumer 12.

A constant direct current supply voltage is thus provided through the circuit arrangement 8 which can be used as supply voltage for the additional electrical consumer 12. This allows such consumers to dispense with batteries as an energy source and so guarantees an uninterrupted supply of the electrical consumer 12 with electrical energy.

LIST OF REFERENCE SYMBOLS

2 model car racing track
4 track element
6*a* first track
6*b* second track
8 circuit arrangement
10*a* model car
10*b* model car
12 electrical consumer
14*a*+ positive busbar
14*a*− negative busbar
14*b*+ positive busbar
14*b*− negative busbar
16 power supply unit
18*a* first driving speed controller
18*b* second driving speed controller
20 positive supply terminal
22 negative supply terminal
24 positive consumer terminal
26 negative consumer terminal While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A circuit arrangement for a model car racing track comprising at least two tracks for model cars, wherein a positive busbar and a negative busbar are in each case assigned to each track, such that a first driving speed controller is connected between a positive supply terminal and the positive busbar of the first track, said positive supply terminal connected in an electrically conductive manner with the positive busbar of the second track and a second driving speed controller is connected between a negative supply terminal and the negative busbar of the second track, said negative supply terminal connected in an electrically conductive manner with the negative busbar of the first track, and wherein the positive supply voltage terminal and the negative supply voltage terminal are assigned to a single power supply unit.

2. The circuit arrangement of claim 1, wherein an electrical consumer is connected between the negative busbar of the first track and the positive busbar of the second track.

3. The circuit arrangement of claim 1, wherein the negative busbar of the second track provides a first arrangement between the positive busbar of the first track and the positive busbar of the second track and the positive busbar of the first track provides a second arrangement between the negative busbar of the first track and the negative busbar of the second track, wherein said first and second arrangements supply constant DC voltage as electrical supply voltage without the interposition of the first and second driving speed controllers.

4. A model car racing track comprising at least two tracks for model cars, wherein each track is assigned a positive busbar and a negative busbar, and a circuit arrangement having at least two tracks for model cars, such that a first driving speed controller is connected between a positive supply terminal and the positive busbar of the first track, said positive supply terminal connected in an electrically conductive manner with the positive busbar of the second track and a second driving speed controller is connected between a negative supply terminal and the negative busbar of the second track, said negative terminal connected in an electrically conductive manner with the negative busbar of the first track, wherein said positive busbar from one of said at least two tracks is connected directly without interposition of an ohmic resistor to said positive supply terminal, and said negative busbar from one of said at least two tracks is connected directly without interposition of an ohmic resistor to said negative supply terminal.

5. The model car racing track of claim 4, including an electrical consumer connected between the negative busbar of the first track and the positive busbar of the second track.

6. The model car racing track of claim 4 including a track element with a positive consumer terminal and a negative consumer terminal to which the electrical consumer is connected.

7. The model car racing track of claim 5 wherein the electrical consumer is designed as an electrical lap counter or as a pit stop module.

8. A track element in a model car racing track, said model car racing track having at least two tracks for model cars, wherein each track is assigned a positive busbar and a negative busbar, and a circuit arrangement having at least two tracks for model cars, such that a first driving speed controller is connected between a positive supply terminal and the positive busbar of the first track, said positive supply terminal connected in an electrically conductive manner with the positive busbar of the second track and a second driving speed controller is connected between a negative supply terminal and the negative busbar of the second track, said negative supply terminal connected in an electrically conductive manner with the negative busbar of the first track, and wherein the track element has at least one positive consumer terminal and one negative consumer terminal for connection of an electrical consumer.

9. The circuit arrangement of claim 1, wherein an electrical consumer is connected between the negative busbar of the first track and the positive busbar of the second track.

10. The circuit arrangement of claim 1, wherein the negative busbar of the second track is arranged between the positive busbar of the first track and the positive busbar of the second track and the positive busbar of the first track is arranged between the negative busbar of the first track and the negative busbar of the second track.

11. The model car racing track of claim 5 including a track element with a positive consumer terminal and a negative consumer terminal to which the electrical consumer is connected.

* * * * *